US009062269B2

(12) United States Patent
Ho et al.

(10) Patent No.: US 9,062,269 B2
(45) Date of Patent: Jun. 23, 2015

(54) METHOD FOR IMPROVING THERMAL-OXIDATIVE STABILITY AND ELASTOMER COMPATIBILITY

(71) Applicant: ExxonMobil Research and Engineering Company, Annandale, NJ (US)

(72) Inventors: Suzzy C. Ho, Princeton, NJ (US); Kathy K. Cooper, South River, NJ (US); Gary Christensen, Salt Lake City, UT (US)

(73) Assignee: ExxonMobil Research and Engineering Company, Annadale, NJ (US)

( * ) Notice: Subject to any disclaimer, the term of this patent is extended or adjusted under 35 U.S.C. 154(b) by 81 days.

(21) Appl. No.: 13/835,031

(22) Filed: Mar. 15, 2013

(65) Prior Publication Data

US 2014/0274836 A1 Sep. 18, 2014

(51) Int. Cl.
*C10M 111/02* (2006.01)
*C10M 105/06* (2006.01)

(52) U.S. Cl.
CPC ..... *C10M 105/06* (2013.01); *C10M 111/02* (2013.01); *C10M 2203/065* (2013.01); *C10N 2230/08* (2013.01); *C10N 2230/10* (2013.01); *C10N 2230/36* (2013.01)

(58) Field of Classification Search
USPC ..... 508/287, 110; 585/25, 26
See application file for complete search history.

(56) References Cited

U.S. PATENT DOCUMENTS 3,036,003 A 5/1962 Dolton, III
3,172,892 A 3/1965 Le Suer et al.
3,200,107 A 8/1965 Le Suer
3,215,707 A 11/1965 Rense
3,219,666 A 11/1965 Norman et al.

(Continued)

FOREIGN PATENT DOCUMENTS

EP 0471071 B1 8/1995
EP 1040115 B1 6/2004

(Continued)

OTHER PUBLICATIONS

Hourani, et al., "Alkylated Naphthalenes as High-Performance Synthetic Lubricating Fluids", Tribology Transactions, 2007, pp. 82-87, vol. 50.

(Continued)

*Primary Examiner* — James Goloboy
(74) *Attorney, Agent, or Firm* — Robert A. Migliorini

(57) ABSTRACT

A method for improving thermo-oxidative stability and elastomer compatibility in an apparatus lubricated with a lubricating oil by using as the lubricating oil a formulated oil including a lubricating oil base stock. The lubricating oil base stock includes a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1. The multi-aromatic base stock has a kinematic viscosity greater than 20 $mm^2/s$ at 100° C.

16 Claims, 5 Drawing Sheets

DSC Oxidation Test Results

| Description | Source | DSC Oxidation Onset Temp.°C |
|---|---|---|
| 1, 1'-Binaphthyl– 500 psi oxygen | Purchased | 297 |
| 2, 2'-Binaphthyl – 500 psi oxygen | Purchased | 312 |
| Alkyl-1,1'-Binaphthyl | Method 3 | 280 |
| Alkyl Perylene | Method 3 | 290 |
| Bis a-methylnaphthalene methane | Method 2 | 263 |
| Bis b-methylnaphthalene methane | Method 2 | 279 |
| Alkylated bis a-methylnaphthalene methane | Method 3 | 269 |
| 1,1'-(1,2-ethanediyl)bis-naphthalene | Purchased | 306 |
| Alkylated 1,1'-(1,2-ethanediyl)bis-naphthalene | Method 3 | 285 |
| AN 5 | Purchased | 233 |
| Radical Coupled AN | Method 1 | 268 |
| Radical Coupled AN | Method 1 | 268 |
| AN 12 | Purchased | 230 |

(56) References Cited

U.S. PATENT DOCUMENTS

| | | | |
|---|---|---|---|
| 3,254,025 | A | 5/1966 | Le Suer |
| 3,275,554 | A | 9/1966 | Wagenaar |
| 3,316,177 | A | 4/1967 | Dorer, Jr. |
| 3,329,658 | A | 7/1967 | Fields |
| 3,341,542 | A | 9/1967 | Le Suer et al. |
| 3,413,347 | A | 11/1968 | Worrel |
| 3,438,757 | A | 4/1969 | Honnen et al. |
| 3,444,170 | A | 5/1969 | Norman et al. |
| 3,449,250 | A | 6/1969 | Fields |
| 3,454,555 | A | 7/1969 | van der Voort et al. |
| 3,454,607 | A | 7/1969 | Le Suer et al. |
| 3,519,565 | A | 7/1970 | Coleman |
| 3,541,012 | A | 11/1970 | Stuebe |
| 3,565,804 | A | 2/1971 | Honnen et al. |
| 3,630,904 | A | 12/1971 | Musser et al. |
| 3,632,511 | A | 1/1972 | Liao |
| 3,666,730 | A | 5/1972 | Coleman |
| 3,687,849 | A | 8/1972 | Abbott |
| 3,697,574 | A | 10/1972 | Piasek et al. |
| 3,702,300 | A | 11/1972 | Coleman |
| 3,725,277 | A | 4/1973 | Worrel |
| 3,725,480 | A | 4/1973 | Traise et al. |
| 3,726,882 | A | 4/1973 | Traise et al. |
| 3,787,374 | A | 1/1974 | Adams |
| 4,100,082 | A | 7/1978 | Clason et al. |
| 4,234,435 | A | 11/1980 | Meinhardt et al. |
| 4,454,059 | A | 6/1984 | Pindar et al. |
| 4,665,275 | A | 5/1987 | Yoshida et al. |
| 4,714,794 | A | 12/1987 | Yoshida et al. |
| 4,737,297 | A | 4/1988 | Yoshida et al. |
| 4,800,032 | A | 1/1989 | Murphy |
| 4,889,647 | A | 12/1989 | Rowan et al. |
| 4,978,464 | A | 12/1990 | Coyle et al. |
| 5,177,284 | A | 1/1993 | Le et al. |
| 5,342,532 | A | 8/1994 | Takei et al. |
| 5,602,086 | A | 2/1997 | Le et al. |
| 5,705,458 | A | 1/1998 | Roby et al. |
| 5,824,627 | A | 10/1998 | McConnachie et al. |
| 5,837,657 | A | 11/1998 | Fang et al. |
| 5,906,968 | A | 5/1999 | McConnachie et al. |
| 6,010,987 | A | 1/2000 | Stiefel et al. |
| 6,110,878 | A | 8/2000 | McConnachie et al. |
| 6,143,701 | A | 11/2000 | Boffa |
| 6,153,564 | A | 11/2000 | Arunasalam et al. |
| 6,232,276 | B1 | 5/2001 | Stiefel et al. |
| 6,239,085 | B1 | 5/2001 | Slack |
| 6,569,820 | B2 | 5/2003 | McConnachie et al. |
| 6,689,725 | B1 | 2/2004 | Gao |
| 6,730,638 | B2 | 5/2004 | Farng et al. |
| 6,734,150 | B2 | 5/2004 | Gao et al. |
| 6,750,183 | B2 * | 6/2004 | Diggs et al. ..... 508/329 |
| 7,300,910 | B2 | 11/2007 | Gutierrez et al. |
| 7,592,495 | B2 | 9/2009 | Hessell et al. |
| 7,923,420 | B2 | 4/2011 | Dodd et al. |
| 2008/0039349 | A1 | 2/2008 | Dodd et al. |
| 2008/0194438 | A1 | 8/2008 | Bera et al. |
| 2009/0203559 | A1 | 8/2009 | Bera et al. |
| 2010/0286414 | A1 | 11/2010 | Bera et al. |
| 2011/0245122 | A1 * | 10/2011 | Strickland et al. ..... 508/370 |

FOREIGN PATENT DOCUMENTS

| | | | |
|---|---|---|---|
| EP | 1693434 | A2 | 8/2006 |
| EP | 2116590 | A1 | 11/2009 |
| FR | 2414543 | A | 8/1979 |
| JP | 61004796 | | 1/1986 |
| WO | 9826030 | A1 | 6/1998 |
| WO | 9931113 | A1 | 6/1999 |
| WO | 9947629 | A1 | 9/1999 |
| WO | 9966013 | A1 | 12/1999 |
| WO | 0204578 | A1 | 1/2002 |
| WO | 02059239 | A2 | 8/2002 |

OTHER PUBLICATIONS

Igarashi et al., "Autoxidation of Alkylnaphthalenes. 1. Self-Inhibition during the Autoxidation of 1- and 2- Methylnaphthalenes Puts a Limit on the Maximum Possible Kinetic Chain Length", J. Am. Chem. Soc., 1992, pp. 7719-7726, vol. 114.

Igarashi et al , "Autoxidation of Alkylnaphthalenes. 2. Inhibition of the Autoxidation of n-Hexadecane at 160 degrees C", J. Am. Chem. Soc., 1992, pp. 7727-7736, vol. 114.

The International Search Report and Written Opinion of PCT/US2014/018139 dated Jun. 2, 2014.

Ouchi, T. et al., "Resins from Formaldehyde. 103. Reaction of Naphthalene with Aqueous Formaldehyde Solution," Bulletin of the Chemical Society of Japan, 1975, vol. 48, No. 3, pp. 918-923.

Li, M. et al., "Changes to Unbound Biomarkers in Low-Rank Coals during Simulated Coalification," Energy & Fuels, 1991, vol. 5, pp. 885-895.

Li, H. et al., "Chemical characterization of exhaust emissions originating from the regeneration mode of a diesel particulate trap," Fuel, 1994, vol. 73, No. 1, pp. 11-16.

Acton, E., "High Temperature Antioxidants for Hydraulic Fluids and Lubricants. Evaluation and Mechanism of Protection of a Silicone Fluid," Journal of Chemical and Engineering Data, 1961, vol. 6, No. 1, pp. 64-75.

Ruzicka, L. et al.. "On Understanding Triterpenes. Synthesis of 1, 10-dimethylpicene, of 1,2,8- and 1,2,10-Trimethylpicene and of 1,2,9,10 tetramethylpicene," Helvetica Chimica Acta, 1938, vol. 21, No. 1, pp. 1735-1746.

* cited by examiner

DSC Oxidation Test Results

| Description | Source | DSC Oxidation Onset Temp.,°C |
|---|---|---|
| 1, 1'-Binaphthyl– 500 psi oxygen | Purchased | 297 |
| 2, 2'-Binaphthyl – 500 psi oxygen | Purchased | 312 |
| Alkyl-1,1'-Binaphthyl | Method 3 | 280 |
| Alkyl Perylene | Method 3 | 290 |
| Bis a-methylnaphthalene methane | Method 2 | 263 |
| Bis b-methylnaphthalene methane | Method 2 | 279 |
| Alkylated bis a-methylnaphthalene methane | Method 3 | 269 |
| 1,1'-(1,2-ethanediyl)bis-naphthalene | Purchased | 306 |
| Alkylated 1,1'-(1,2-ethanediyl)bis-naphthalene | Method 3 | 285 |
| AN 5 | Purchased | 233 |
| Radical Coupled AN | Method 1 | 268 |
| Radical Coupled AN | Method 1 | 268 |
| AN 12 | Purchased | 230 |

FIG. 1

Radical Coupled AN was compared to three commercial AN products in the following formulation

| Component/Description | Units | Amount |
|---|---|---|
| Additives | | 2.780 |
| High Viscosity PAO | WT% | 47.220 |
| Low Viscosity Polyalphaolefin, wt.% | WT% | 25.000 |
| Alkyl Naphthalene Basestock | WT% | 25.000 |

| Neat Base Stocks | | | | |
|---|---|---|---|---|
| Alkyl Naphthalene Basestock | AN 5 | AN 9 | AN 19 | Radical Coupled AN |
| Kinematic Viscosity, 100°C $mm^2/s$ | 4.8 | 8.9 | 18.7 | 120.1 |
| Kinematic Viscosity, 40°C $mm^2/s$ | 28 | 72 | 177 | 4747 |
| Viscosity Index, Calculated | 76 | 86 | 119 | 90 |
| Aromatic/Aliphatic Carbon Ratio | 0.59 | 0.44 | 0.24 | 0.59 |
| | | | | |
| Formulated Blends | | | | |
| KV @ 100°C, cSt | 21.3 | 25.3 | 30.0 | 42.3 |
| KV @ 40°C, cSt | 145 | 188 | 234 | 401 |
| Viscosity Index, Calculated | 172 | 168 | 168 | 159 |
| Blend Appearance | Clear & Bright | Clear & Bright | Clear & Bright | Clear & Bright |
| Bulk Fluid Oxidation Test 150°C of Blends | | | | |
| 1008 Oxidation Test Sludge Rating | Moderate | Moderate | Moderate | Heavy |
| TAN, 504 hrs 150°C | 0.078 | 0.054 | 0.079 | 1.250 |
| TAN, 672 hrs 150°C | 0.079 | 0.093 | 0.098 | 1.190 |
| TAN, 840 hrs 150°C | 0.115 | 0.150 | 0.272 | 1.638 |
| TAN, 1008 hrs 150°C | 2.951 | 5.370 | 8.568 | 1.793 |
| NBR28SX, 100°C, 168 Hours, % Volume Change | 13.0 | 9.2 | 5.1 | 6.7 |

FIG. 2

Alkyl-1,1'-binaphthyl was compared to three commercial AN products in the following formulation

| Component/Description | Units | Amount |
|---|---|---|
| Additives | WT% | 2.780 |
| Low Viscosity Polyalphaolefin, wt.% | WT% | 47.220 |
| Alkyl Naphthalene Basestock | WT% | 50.000 |

| Neat Base Stocks | | | | |
|---|---|---|---|---|
| Alkyl Naphthalene Basestock | AN 5 | AN 9 | AN 19 | Alkyl-1, 1-Binapthyl |
| Kinematic Viscosity, 100°C $mm^2/s$ | 4.8 | 8.9 | 18.5 | 43.8 |
| Kinematic Viscosity, 40°C $mm^2/s$ | 28 | 72 | 177 | 1076 |
| Viscosity Index, Calculated | 80 | 96 | 118 | 75 |
| Aromatic/Aliphatic Carbon Ratio | 0.59 | 0.44 | 0.24 | >0.62 |
| | | | | |
| Formulated Blends | | | | |
| TAN | 0.650 | 0.639 | 0.651 | 0.497 |
| KV @ 100°C, cSt | 4.3 | 5.7 | 7.9 | 10.1 |
| KV @ 40°C, cSt | 21 | 33 | 49 | 79 |
| Viscosity Index, Calculated | 103 | 114 | 130 | 109 |
| Blend Appearance | Clear & Bright | Clear & Bright | Clear & Bright | C & B |
| Bulk Fluid Oxidation Test 150° C of Blends | | | | |
| 1008 Oxidation Test Sludge Rating | Moderate | Light | Light | Trace |
| TAN, 336 hrs | 0.18 | 0.03 | 0.25 | --- |
| TAN, 504 hrs | 0.32 | 0.46 | 4.46 | 1.23 |
| TAN, 672 hrs | 0.31 | 2.87 | 7.17 | 1.43 |
| TAN, 840 hrs | 1.40 | 7.63 | 9.64 | 1.64 |
| TAN 1008 hrs | 2.10 | 11.96 | 25.02 | 2.15 |

FIG. 3

| Purchased Commercial Products | Mono-Alkyl Naphthalene | Di-Alkyl Naphthalene | Tri-Alkyl Naphthalene | Tetra-Alkyl Naphthalene | Aromatic Carbon | Aliphatic Carbon | Aromatic/ Aliphatic Carbon Ratio | KV 100°C | KV 40°C | Viscosity Index |
|---|---|---|---|---|---|---|---|---|---|---|
| Method | GC | GC | GC | GC | per 100 g | per 100 g | | cSt | cSt | |
| | Wt % | Wt % | Wt % | Wt % | | | | | | |
| | | | | | | | | | | |
| AN 5 | 90.85 | 8.37 | 0.07 | 0.00 | 2.727 | 4.599 | 0.593 | 4.7 | 29 | 74 |
| AN 6 | 93.42 | 6.09 | 0.00 | 0.00 | 2.653 | 4.682 | 0.567 | 5.6 | 36 | 90 |
| AN 9 | 25.38 | 33.88 | 40.73 | 0.00 | 2.232 | 5.101 | 0.438 | 9.2 | 72 | 103 |
| AN 12 | 13.06 | 31.57 | 55.26 | 0.00 | 1.782 | 5.506 | 0.324 | 12.4 | 109 | 105 |
| AN 14 | 4.00 | 37.80 | 58.20 | 0.00 | 1.871 | 5.433 | 0.344 | 13.5 | 114 | 110 |
| AN 19 | 2.12 | 11.91 | 52.12 | 33.81 | 1.393 | 5.866 | 0.237 | 18.7 | 177 | 118 |
| AN 20 | 0.00 | 2.74 | 54.57 | 42.69 | 1.283 | 5.970 | 0.215 | 19.8 | 193 | 118 |

FIG. 4

METHOD FOR IMPROVING THERMAL-OXIDATIVE STABILITY AND ELASTOMER COMPATIBILITY

FIELD

This disclosure relates to multi-aromatic base stocks, lubricating oils containing the multi-aromatic base stocks, and, in an industrial, automotive or other apparatus lubricated with the lubricating oil, improving thermo-oxidative stability and elastomer compatibility.

BACKGROUND

Lubricants in commercial use today are prepared from a variety of natural and synthetic base stocks admixed with various additive packages and solvents depending upon their intended application. The base stocks typically include mineral oils, poly alpha olefins (PAO), gas-to-liquid base oils (GTL), silicone oils, phosphate esters, diesters, polyol esters, and the like.

Oxidation resistance of a lubricant is the key to achieve long oil life by controlling oil viscosity and total acid number (TAN) increase, minimizing deposit (varnish/sludge) formation and maintaining good heat transfer and lubricating properties. For industrial lubricants, the oxidation performance relies mainly on the basestocks used.

Alkylated naphthalene (AN) is a base stock used in conventional automotive and industrial lubricant products. A double ring molecule such as naphthalene has better oxidation performance than single ring aromatic. The superior oxidation performance of AN is limited to its lower molecular weight product. As the molecular weight AN increases through addition of alkyl chain to the aromatic ring, its oxidation performance begins to suffer. At the same time, there is a need for higher molecular weight/viscosity AN in order to reduce interaction with the elastomer seal component. Conventional AN products cannot meet both of these objectives namely, an increase in viscosity while retaining oxidation performance and provide adequate seal manageability.

Alkyl aromatic basestocks have been used to improve the oxidation and hydrolytic stabilities of lubricant formulations. One drawback of the lower molecular weight alkyl aromatic basestock is its seal management ability from its interaction with the elastomer components in the equipment resulting in swelling and degradation of the seal materials that can lead to leakage of the lubricant.

One way to reduce the interaction of basestock and elastomers is to increase the molecular weight or size of the basestock molecule. Conventional way to increase the molecular weight of alkyl aromatic basestocks is by introducing alkyl chains to the aromatic ring. This approach however increases the paraffinic nature and reduces the aromatic content of the molecule. As the basestock became more paraffinic, its oxidation stability decreases as well.

Alkyl aromatics, specifically, low viscosity alkyl naphthalene, has been shown to provide improvement in oxidation performance in a lubricant formulation. However, its impact on elastomer compatibility has limited its use to lower concentration.

Therefore, there is a need for a base stock that can meet both of the above objectives: increase viscosity while retain oxidation performance and elastomer compatibility.

The present disclosure also provides many additional advantages, which shall become apparent as described below.

SUMMARY

This disclosure is directed in part to a base stock containing multiple naphthalene rings. The base stock exhibits significantly superior thermal-oxidative stability and elastomer compatibility/manageability in neat form or in lubricant formulations in comparison with conventional alkyl naphthalene (AN) base stocks.

This disclosure relates in part to a method for improving thermo-oxidative stability and elastomer compatibility in an apparatus lubricated with a lubricating oil by using as the lubricating oil a formulated oil comprising a lubricating oil base stock. The lubricating oil base stock comprises a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 032:1, preferably greater than 0.44:1, and more preferably greater than 0.57:1. The multi-aromatic base stock has a kinematic viscosity greater than 20 $mm^2/s$ at 100° C. Thermo-oxidative stability and elastomer compatibility are improved as compared to thermo-oxidative stability and elastomer compatibility achieved using a lubricating oil base stock other than the multi-aromatic base stock.

This disclosure also relates in part to a lubricating oil comprising a lubricating oil base stock. The lubricating oil base stock comprises a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1, preferably greater than 0.44:1, and more preferably greater than 0.57:1. The multi-aromatic base stock has a kinematic viscosity greater than 20 $mm^2/s$ at 100° C. In an apparatus lubricated with the lubricating oil, thermo-oxidative stability and elastomer compatibility are improved as compared to thermo-oxidative stability and elastomer compatibility achieved using a lubricating oil base stock other than the multi-aromatic base stock.

This disclosure also relates in part to a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1, preferably greater than 0.44:1, and more preferably greater than 0.57:1. The multi-aromatic base stock has a kinematic viscosity greater than 20 $mm^2/s$ at 100° C. in an apparatus lubricated with a lubricating oil comprising the multiaromatic base stock, thermo-oxidative stability and elastomer compatibility are improved as compared to thermo-oxidative stability and elastomer compatibility achieved using a lubricating oil base stock other than the multi-aromatic base stock.

It has been surprisingly found that the multi-naphthalene containing base stocks of this disclosure improve both thermo-oxidation stability and elastomer compatibility/manageability, when compared to conventional alkylated naphthalene base stocks. The base stocks of this disclosure minimize varnish, sludge, wear and corrosion through the reduction of oxidation byproducts in lubricant formulations and thus extended oil drain interval, increase lubricant service life, reduce environmental footprint and provide sustainability benefit.

The multi-naphthalene containing base stocks of this disclosure are differentiated from conventional alkyl naphthalene base stocks in that the multi-naphthalene containing base stocks are based on unconventional concept of combining both higher molecular weight/viscosity (e.g., improved elastomer manageability) and high oxidation onset temperatures as measured by Differential Scanning calorimetry (e.g., improved thermo-oxidation stability). This unconventional concept is achieved by incorporating multiple naphthalene rings into the same molecule in order to produce a basestock composition with high aromatic to aliphatic carbon ratio that is critical for maintaining and improving the thermo-oxidation stability and elastomer manageability.

Further objects, features and advantages of the present disclosure will be understood by reference to the following drawings and detailed description.

BRIEF DESCRIPTION OF DRAWINGS

FIG. 1 lists basestocks or molecules that were prepared and examined by differential scanning calorimetry (DSC, 100 psi air, 10° C./min) to determine the oxidation onset temperature as shown in the Examples.

FIG. 2 lists kinematic viscosities (100° C. $mm^2/s$ and 40° C. $mm^2/s$) for neat base stocks and formulated blends, and lists oxidation test results and elastomer compatibility test results for the blends as shown in the Examples.

FIG. 3 lists kinematic viscosities (100° C. $mm^2/s$ and 40° C. $mm^2/s$) for neat base stocks and formulated blends, and lists oxidation test results for the blends as shown in the Examples.

FIG. 4 lists gas chromatographic (GC) data for monoalkyl, di-alkyl, tri-alkyl and tetra-alkyl naphthalenes, aromatic/aliphatic carbon ratios and kinematic viscosities (100° C. $mm^2/s$ and 40° C. $mm^2/s$).

DETAILED DESCRIPTION

Figure 5:
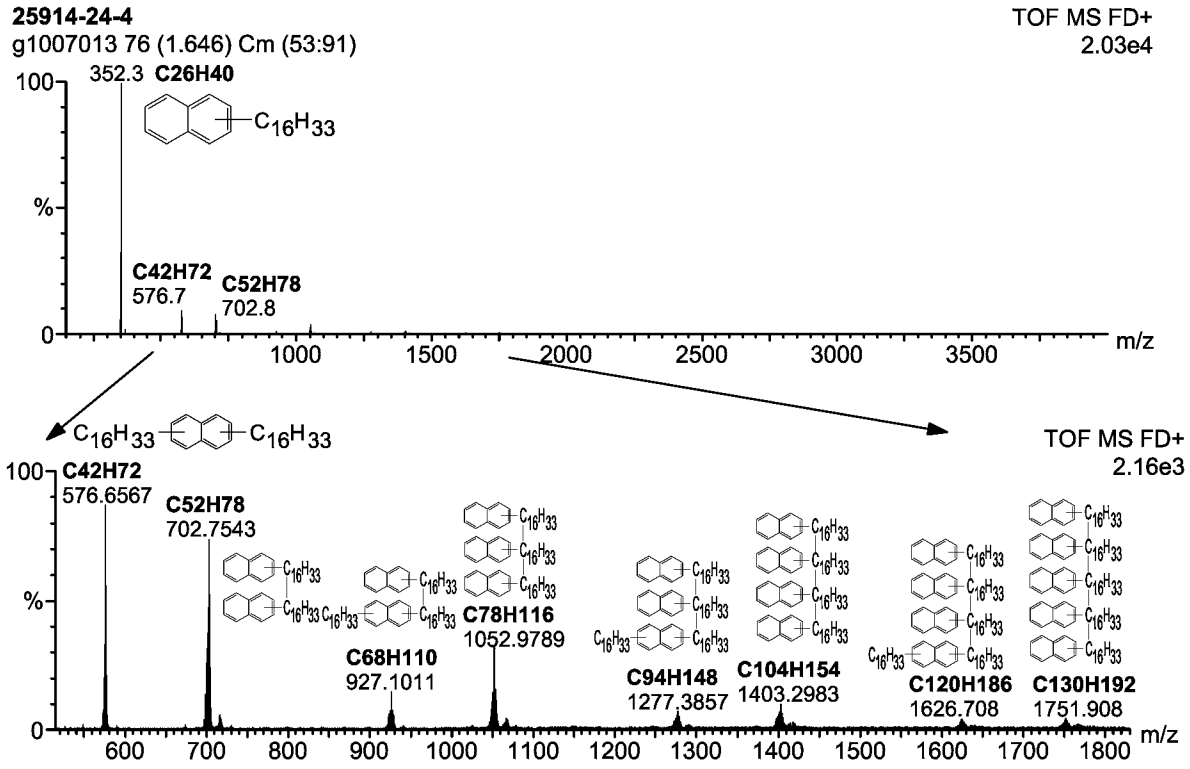
FIG. 5 shows the mass spectrographic analysis of the product made by an oxidative coupling reaction carried out in accordance with Method 1 as shown in the Examples.

All numerical values within the detailed description and the claims herein are modified by "about" or "approximately" the indicated value, and take into account experimental error and variations that would be expected by a person having ordinary skill in the art.

This disclosure provides lubricating oils useful as industrial oils (e.g., circulating oils, compressor oils, gear oils, and the like), automotive oils (engine oils, diesel engine oils, and the like), marine oils (engine oils, diesel engine oils, and the like), mechanical system oils, and in other applications characterized by an excellent balance of thermo-oxidative stability and elastomer compatibility/manageability. The lubricating oils are based on high quality base stocks including a multi-aromatic base stock. The lubricating oil base stock can be any oil boiling in the lube oil boiling range, typically between 100 to 450° C. In the present specification and claims, the terms base oil(s) and base stock(s) are used interchangeably. The lubricating oils of this disclosure can be used preferably in the formulation of industrial lubricants, and also in the formulation of automotive engine lubricants, greases, hydraulic lubricants, marine lubricants, gas turbine engine oils, gear oils, and the like. As used herein, the term "apparatus" refers to any industrial (e.g., compressor, gear box, etc.), automotive (e.g., engine, diesel engine, etc), marine (e.g., engine, diesel engine, etc.), mechanical system, or other device or equipment lubricated with a lubricating oil.

As used herein, thermo-oxidative stability is determined in accordance with the testing procedure described in the Examples, and elastomer compatibility is determined by ISO 1817. Viscosity is determined by ASTM D-445.

Lubricating Oil Base Stocks

A wide range of lubricating oils is known in the art. Lubricating oils that are useful in the present disclosure are both natural oils and synthetic oils. Natural and synthetic oils (or mixtures thereof) can be used unrefined, refined, or rerefined (the latter is also known as reclaimed or reprocessed oil). Unrefined oils are those obtained directly from a natural or synthetic source and used without added purification. These include shale oil obtained directly from retorting operations, petroleum oil obtained directly from primary distillation, and ester oil obtained directly from an esterification process. Refined oils are similar to the oils discussed for unrefined oils except refined oils are subjected to one or more purification steps to improve the at least one lubricating oil property. One skilled in the art is familiar with many purification processes. These processes include solvent extraction, secondary distillation, acid extraction, base extraction, filtration, and percolation. Rerefined oils are obtained by processes analogous to refined oils but using an oil that has been previously used as a feed stock.

Groups I, II, III, IV and V are broad categories of base oil stocks developed and defined by the American Petroleum Institute (API Publication 1509; www.API.org) to create guidelines for lubricant base oils. Group I base stocks generally have a viscosity index of between 80 to 120 and contain greater than 0.03% sulfur and less than 90% saturates. Group II base stocks generally have a viscosity index of between 80 to 120, and contain less than or equal to 0.03% sulfur and greater than or equal to 90% saturates. Group III stock generally has a viscosity index greater than 120 and contains less than or equal to 0.03% sulfur and greater than 90% saturates. Group IV includes polyalphaolefins (PAO). Group V base stocks include base stocks not included in Groups I-IV. The table below summarizes properties of each of these five groups.

| | Base Oil Properties | | |
|---|---|---|---|
| | Saturates | Sulfur | Viscosity Index |
| Group I | <90 and/or | >0.03% and | ≥80 and <120 |
| Group II | ≥90 and | ≤0.03% and | ≥80 and <120 |
| Group III | ≥90 and | ≤0.03% and | ≥120 |
| Group IV | Includes polyalphaolefins (PAO) | | |
| Group V | All other base oil stocks not included in Groups I, II, III or IV | | |

Natural oils include animal oils, vegetable oils (castor oil and lard oil, for example), and mineral oils. Animal and vegetable oils possessing favorable thermal oxidative stability can be used. Of the natural oils, mineral oils are preferred. Mineral oils vary widely as to their crude source, for example, as to whether they are paraffinic, naphthenic, or mixed paraffinic-naphthenic. Oils derived from coal or shale are also useful in the present disclosure. Natural oils vary also as to the method used for their production and purification, for example, their distillation range and whether they are straight run or cracked, hydrorefined, or solvent extracted.

Group II and/or Group III hydroprocessed or hydrocracked base stocks, as well as synthetic oils such as polyalphaolefins, alkyl aromatics and synthetic esters, i.e. Group IV and Group V oils are also well known base stock oils. The Group III base stock is highly paraffinic with saturates level higher than 90%, preferably 95%, a viscosity index greater than 125, preferably greater than 135, or more preferably greater than 140, very low aromatics of 3%, preferably less than 1%, and aniline point of 118 or higher.

Synthetic oils include hydrocarbon oil such as polymerized and interpolymerized olefins (polybutylenes, polypropylenes, propylene isobutylene copolymers, ethylene-olefin copolymers, and ethylene-alphaolefin copolymers, for example). Polyalphaolefin (PAO) oil base stocks, the Group IV API base stocks, are a commonly used synthetic hydrocarbon oil. By way of example, PAOs derived from $C_6$, $C_8$, $C_{10}$, $C_{12}$, $C_{14}$, $C_{16}$ olefins or mixtures thereof may be utilized. See U.S. Pat. Nos. 4,956,122; 4,827,064; and 4,827,073, which are incorporated herein by reference in their entirety. Group IV oils, that is, the PAO base stocks have viscosity indices preferably greater than 130, more preferably greater than 135, still more preferably greater than 140.

Esters may be useful in the lubricating oils of this disclosure. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those which are obtained by reacting one or more polyhydric alcohols, preferably the hindered polyols such as the neopentyl polyols; e.g., neopentyl glycol, trimethylol ethane, 2-methyl-2-propyl-1,3-propanediol, trimethylol propane, pentaerythritol and dipentaerythritol with alkanoic acids containing at least 4 carbon atoms, preferably $C_5$ to $C_{30}$ acids such as saturated straight chain fatty acids including caprylic acid, capric acids, lauric acid, myristic acid, palmitic acid, stearic acid, arachic acid, and behenic acid, or the corresponding branched chain fatty acids or unsaturated fatty acids such as oleic acid, or mixtures of any of these materials.

Esters should be used in a amount such that the improved thermo-oxidative stability and elastomer compatibility provided by the lubricating oils of this disclosure are not adversely affected. The esters preferably have a D5293 viscosity of less than 10,000 cP at −35° C.

Non-conventional or unconventional base stocks and/or base oils include one or a mixture of base stock(s) and/or base oil(s) derived from: (1) one or more Gas-to-Liquids (GTL) materials, as well as (2) hydrodewaxed, or hydroisomerized/cat (and/or solvent) dewaxed base stock(s) and/or base oils derived from synthetic wax, natural wax or waxy feeds, mineral and/or non-mineral oil waxy feed stocks such as gas oils, slack waxes (derived from the solvent dewaxing of natural oils, mineral oils or synthetic oils; e.g., Fischer-Tropsch feed stocks), natural waxes, and waxy stocks such as gas oils, waxy fuels hydrocracker bottoms, waxy raffinate, hydrocrackate, thermal crackates, foots oil or other mineral, mineral oil, or even non-petroleum oil derived waxy materials such as waxy materials recovered from coal liquefaction or shale oil, linear or branched hydrocarbyl compounds with carbon number of 20 or greater, preferably 30 or greater and mixtures of such base stocks and/or base oils.

GTL materials are materials that are derived via one or more synthesis, combination, transformation, rearrangement, and/or degradation/deconstructive processes from gaseous carbon-containing compounds, hydrogen-containing compounds and/or elements as feed stocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons; for example, waxy synthesized hydrocarbons, that are themselves derived from simpler gaseous carbon-containing compounds, hydrogen-containing compounds and/or elements as feed stocks. GTL base stock(s) and/or base oil(s) include oils boiling in the lube oil boiling range (1) separated/fractionated from synthesized GTL materials such as, for example, by distillation and subsequently subjected to a final wax processing step which involves either or both of a catalytic dewaxing process, or a solvent dewaxing process, to produce lube oils of reduced/low pour point; (2) synthesized wax isomerates, comprising, for example, hydrodewaxed or hydroisomerized cat and/or solvent dewaxed synthesized wax or waxy hydrocarbons; (3) hydrodewaxed or hydroisomerized eat and/or solvent dewaxed Fischer-Tropsch (F-T) material (i.e., hydrocarbons, waxy hydrocarbons, waxes and possible analogous oxygenates); preferably hydrodewaxed or hydroisomerized/followed by cat and/or solvent dewaxing dewaxed F-T waxy hydrocarbons, or hydrodewaxed or hydroisomerized/followed by cat (or solvent) dewaxing dewaxed, F-T waxes, or mixtures thereof.

GTL base stock(s) and/or base oil(s) derived from GTL materials, especially, hydrodewaxed or hydroisomerized/followed by cat and/or solvent dewaxed wax or waxy feed, preferably F-T material derived base stock(s) and/or base oil(s), are characterized typically as having kinematic viscosities at 100° C. of from 2 $mm^2/s$ to 50 $mm^2/s$ (ASTM D445). They are further characterized typically as having pour points of −5° C. to −40° C. or lower (ASTM D97). They are also characterized typically as having viscosity indices of 80 to 140 or greater (ASTM D2270).

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this materially especially suitable for the formulation of low SAP products.

The term GTL base stock and/or base oil and/or wax isomerate base stock and/or base oil is to be understood as embracing individual fractions of such materials of wide viscosity range as recovered in the production process, mixtures of two or more of such fractions, as well as mixtures of one or two or more low viscosity fractions with one, two or more higher viscosity fractions to produce a blend wherein the blend exhibits a target kinematic viscosity.

The GTL material, from which the GTL base stock(s) and/or base oil(s) is/are derived is preferably an F-T material (i.e., hydrocarbons, waxy hydrocarbons, wax).

Base oils for use in the formulated lubricating oils useful in the present disclosure are any of the variety of oils corresponding to API Group I, Group II, Group III, Group IV, and Group V oils and mixtures thereof, preferably API Group II, Group III, Group IV, and Group V oils and mixtures thereof, more preferably the Group III to Group V base oils due to their exceptional volatility, stability, viscometric and cleanliness features. Minor quantities of Group I stock, such as the amount used to dilute additives for blending into formulated lube oil products, can be tolerated but should be kept to a minimum, i.e. amounts only associated with their use as diluent/carrier oil for additives used on an "as-received" basis. Even in regard to the Group II stocks, it is preferred that the Group II stock be in the higher quality range associated with that stock, i.e. a Group II stock having a viscosity index in the range 100<VI<120.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) and hydrodewaxed, or hydroisomerized/cat (and/or solvent) dewaxed base stock(s) and/or base oil(s) typically have very low sulfur and nitrogen content, generally containing less than 10 ppm, and more typically less than 5 ppm of each of these elements. The sulfur and nitrogen content of GTL base stock(s) and/or base oil(s) obtained from F-T material, especially F-T wax, is essentially nil. In addition, the absence of phosphorous and aromatics make this material especially suitable for the formulation of low sulfur, sulfated ash, and phosphorus (low SAP) products.

The basestock component of the present lubricating oils will typically be from 80 to 99 weight percent of the total composition (all proportions and percentages set out in this specification are by weight unless the contrary is stated) and more usually in the range of 90 to 99 weight percent.

Multi-Aromatic Base Stocks

The multi-aromatic base stocks of the present disclosure includes oligomeric/polymeric materials of the formula:

$$R^1—R^2—(X—R^2)_n—R^1$$

wherein each moiety $R^2$ (e.g., naphthalene) represents a substituted or unsubstituted aromatic moiety; each X is a linking moiety that is carbon-carbon single bond between the carbon atoms of adjacent moieties $R^2$ or a linking group, n is a number from 1 to 2000, and each $R^1$ is a terminal group. The ratio of the total number of aromatic ring carbon atoms to aliphatic carbon atoms in the oligomeric/polymeric material is greater than 0.32:1, preferably greater than 0.44:1, and more preferably greater than 0.57:1.

Aromatic moieties $R^2$ of the above formula can be polynuclear carbocyclic moieties or mono- or polynuclear heterocyclic moieties. Polynuclear carbocyclic moieties may comprise two or more fused rings, each ring having 4 to 10 carbon atoms (e.g., naphthalene). Suitable carbocyclic polynuclear moieties may also be linked mononuclear aromatic moieties, such as biphenyl, or may comprise linked, fused rings (e.g., binaphthyl). Examples of suitable polynuclear carbocyclic aromatic moieties include naphthalene, anthracene, phenanthrene, cyclopentenophenanthrene, benzanthracene, dibenzanthracene, chrysene, pyrene, benzpyrene and coronene and dimer, trimer and higher polymers thereof. Heterocyclic moieties $R^2$ include those comprising one or more rings each containing 4 to 10 atoms, including one or more hetero atoms selected from N, O and S. Examples of suitable monocyclic heterocyclic aromatic moieties include pyrrole, furan, thiophene, imidazole, oxazole, thiazole, pyrazole, pyridine, pyrimidine and purine. Suitable polynuclear heterocyclic moieties $R^2$ include, for example, quinoline, isoquinoline, carbazole, dipyridyl, cinnoline, phthalazine, quinazoline, quinoxaline and phenanthroline. Each aromatic moiety ($R^2$) may be independently selected such that all moieties ($R^2$) are the same or different. The preferred polycyclic carbocyclic aromatic moiety is naphthalene. Polycyclic heterocycles are preferred over monocyclic heterocycles.

Each aromatic moiety $R^2$ may independently be unsubstituted or substituted with 1 to 10 groups selected from H, $—OR_1$, $—N(R_1)_2$, F, Cl, Br, I, $—(X—(R^2)—R^1)$, $—S(O)_w R_1$, $—(CZ)_x—(Z)_y—R_1$ and $—(Z)_y—(CZ)_x—R_1$, wherein w is 0 to 3, each Z is independently O, $—N(R_1)_2$ or S, x and y are independently 0 or 1, each $R_1$ is independently H or a linear or branched, saturated or unsaturated hydrocarbyl group having from 1 to 200 carbon atoms, optionally mono- or poly-substituted with one or more groups selected from $—OR_2$, $—N(R_2)_2$, F, Cl, Br, I, $—S(O)_w R_2$, $—(CZ)_x—(Z)_y—R_2$ and $—(Z)_y—(CZ)_x—R_2$, wherein w, x, y and Z are as defined above, $R_2$ is a hydrocarbyl group having 1 to 200 carbon atoms, and $R^1$ is a terminal group.

Each linking group (X) may be the same or different, and can be a carbon to carbon single bond between the carbon atoms of adjacent moieties $R^2$ or a linking group. Suitable linking groups include as follows:

alkylene linkages, such as $—R_3—$;

ether linkages, such as —O—, $—O(R_3)—$, $—O—((R_3)—O)_a—$ and $—((R_3)—O)_a—(R_3)—$;

acyl linkages, including $—(CO)_2—$, $—(CO)—(R_3)—$, $—(CO)—((R_3)—(CO))_a$, $—(CO)—((R_3)—(CO))_a—(R_3)—$ and $—((R_3)—(CO))_a—(R_3)—$;

ester linkages, such as $—(CO_2)—$, $—(CO_2)—R_3)—$, $—(CO_2)—((R_3)—(CO_2))_a—$, $—(CO_2)—((R_3)—(CO))_a—(R_3)—$, $—((R_3)—(CO_2)_a—(R_3)—$, $—(OCO)—(R_3)—$, $—(OCO)—((R_3—(OCO))_a—$, and $—(OCO)—((R_3)—(CO_3))_a—$;

anhydride linkages, including $—(CO_2CO)—$, $—(R_3)—(CO_2CO)—$ and $—(R_3)—(CO_2(CO)—(R_3—$;

ether-acyl linkages, such as $—O—(R_3)—(CO)—$, $—(R_3)—O—(R_3)—(CO)—$, $—O—(R_3)—(CO)—(R_3)—$ and $—(R_3)—O—(R_3)—(CO)—(R_3)—$;

ether-ester linkages such as $—O—(R_3)—(CO_2)—$, $—(R_3)—O—(R_3)—(CO_2)—$, $—O—(R_3)—(CO_2)—(R_3)—$, $—(R_3)—O—(R_3)—(CO_2)—(R_3)—$, $—O—(R_3)—(OCO)—$, $—(R_3)—O—(R_3)—(OCO)—$, $—O—(R_3)—(OCO)—(R_3)—$, and $—(R_3)—O—(R_3)—(OCO)—(R_3)—$;

acyl-ester linkages, including $—(CO)—(R_3)—(CO_2)—$, $—(R_3)—(CO)—(R_3)—(CO_2)—$, $—(CO)—(R_3)—(CO_2)—(R_3)—(R_3)—(CO)—(R_3)—(CO_2)—(R_3)—$, $—(CO)—(R_3)—(OCO)—$, $—(R_3)—(CO)—(R_3)—(OCO)—$, $—(CO)—(R_3)—(OCO)—(R_3)—$, and $—(R_3)—(CO)—(R_3)—(OCO)—(R_3)—$;

amino linkages, such as $—N(R_1)—$, $—N(R_1)—(R_3)—$, $—N(R_1)—((R_3)—N(R_1))_a—$, and $—((R_3)—N(R_1))_a—(R_3)—$;

amido linkages, for example, $—N(R_1)—(CO)—$, $—N(R_1)—(CO)—(R_3)—(CO)—N(R_1)—$, $—(CO)—N(R_1)—(R_3)—N(R_1)—(CO)—$, $—(CO)—N(R_1)—(R_3)—(CO)—N(R_1)—$, $—(R_3)—N(R_1)—(CO)—(R_3)—(CO)—N$ $(R_1)$—$(R_3)$—, —$(R_3)$—(CO)—$N(R_1)$—$(R_3)$—$N(R_1)$—(CO)—$(R_3)$— and —$(R_3)$—(CO)—$N(R_1)$—$(R_3)$—(CO)—$N(R_1)$—$(R_3)$—;

carbamido linkages, such as —$N(R_1)$—(CO)—$N(R_1)$—, —$(R_3)$—$N(R_1)$—(CO)—$N(R_1)$—, —$(R_3)$—$N(R_1)$—(CO)—$N(R_1)$—$(R_3)$—;

urethane linkages, including —$N(R_1)$—$(CO_2)$—, —$(R_3)$—$N(R_1)$—$(CO_2)$—, —$N(R_1)$—$(CO_2)$—$(R_3)$—, and —$(R_3)$—$N(R_1)$—$(CO_2)$—$(R_3)$—; and sulfur linkages, for example —$S_c$—, —$(R_3)$—$S_c$—, —$(R_3)$—$S_c$—$(R_3)$—, —$SO_d$—, —$(R_3)$—$SO_d$—, —$SO_d$—$[(R_3)$—$SO_d]_a$—, —$SO_d$—$[(R_3)$—$SO_d]_a$—$(R_3)$— and —$[(R_3)$—$SO_d]_a$—$(R_2)$—;

wherein $R_1$ is as previously defined, each $R_3$ is independently a linear or branched, saturated or unsaturated hydrocarbyl group having from 1 to 100 carbon atoms, more preferably from 1 to 30 carbon atoms, and most preferably from 1 to 10 carbon atoms, optionally mono- or polysubstituted with $OR_1$, $N(R_1)_2$, F, Cl, Br, I, $S(O)_wR_1$, $(CZ)_x$—$(Z)_y$—$R_1$, $(Z)_y$—$(CZ)_x$—$R_1$, wherein w and Z are as previously defined; a is from 1 to 40, b is either 1 or 2, c is from 1 to 8, and d is from 1 to 3.

Preferred linking groups (X) are alkylene linkages such as —$CH_3CHC(CH_3)_2$—, or —$C(CH_3)_2$—. The number of aliphatic carbon atoms and aromatic ring carbon atoms in linking moiety (X) are included when calculating the ratio of aromatic ring carbon atoms to aliphatic carbon atoms for the oligomer/polymer. The value of n is from 1 to 2000 or greater, preferably from 1 to 1000.

Each terminal group ($R^1$) is independently selected from H, $OR_1$, $N(R_1)_2$, F, Cl, Br, I, $S(O)_wR_1$, $(CZ)_x$—$(Z)_y$—$R_1$ or $(Z)_y$—$(CZ)_x$—$R_1$, wherein $R_1$, w, x, y and Z are as previously defined.

Illustrative multi-aromatic base stocks of this disclosure include, for example, 1,1'-binaphthyl, 2,2'-binaphthyl, alkyl-1,1'-binaphthyl, bis-α-methylnaphthalene methane, bis-β-methylnaphthalene methane, alkylated bis-α-methylnaphthalene methane, alkylated bis-β-methylnaphthalene methane, 1,1'-(1,2-ethanediyl)bis-naphthalene, alkylated 1,1'-(1,2-ethanediyl)bis-naphthalene, and the like, including mixtures thereof.

The multi-aromatic base stocks of the present disclosure can be prepared by conventional methods. Methods employed to produce the multi-aromatic base stocks of the present disclosure include, for example, oxidative coupling of alkyl naphthalene molecules, condensation of alkyl naphthalene molecules with aldehyde, and aromatic alkylation of multi-naphthalene ring compounds with alkylating agents. These methods are each illustrated and more fully described in the Examples hereinbelow. Other methods are described, for example, in U.S. Pat. No. 7,300,910, the disclosure of which is incorporated by reference herein in its entirety.

The multi-aromatic base stocks of this disclosure have a viscosity greater than 20 $mm^2/s$ at 100° C., preferably greater than 25 $mm^2/s$ at 100° C., and more preferably greater than 30 $mm^2/s$ at 100° C. (ASTM D-445). Viscosities used herein are kinematic viscosities unless otherwise specified, determined at 40° C. or 100° C. according to any such suitable method for measuring kinematic viscosities, e.g., ASTM D445.

The multi-aromatic base stocks of this disclosure can be used in neat form. Lubricant compositions can contain greater than 5 wt. % of the multi-aromatic base stocks of this disclosure, preferably from 5 wt. % or 10 wt. % or 15 wt. % to 95 wt. %, more preferably from 20 wt. % to 95 wt. %, and even more preferably from 25 wt. % to 95 wt. %, depending on the application.

Other Additives

The formulated lubricating oil useful in the present disclosure may additionally contain one or more of the other commonly used lubricating oil performance additives including but not limited to dispersants, other detergents, corrosion inhibitors, rust inhibitors, metal deactivators, other anti-wear agents and/or extreme pressure additives, anti-seizure agents, wax modifiers, viscosity index improvers, viscosity modifiers, fluid-loss additives, seal compatibility agents, other friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in Lubricants and Related Products, Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

The types and quantities of performance additives used in combination with the instant disclosure in lubricant compositions are not limited by the examples shown herein as illustrations.

Viscosity Improvers

Viscosity improvers (also known as Viscosity Index modifiers, and VI improvers) increase the viscosity of the oil composition at elevated temperatures which increases film thickness, while having limited effect on viscosity at low temperatures.

Suitable viscosity improvers include high molecular weight hydrocarbons, polyesters and viscosity index improver dispersants that function as both a viscosity index improver and a dispersant. Typical molecular weights of these polymers are between 10,000 to 1,000,000, more typically 20,000 to 500,000, and even more typically between 50,000 and 200,000.

Examples of suitable viscosity improvers are polymers and copolymers of methacrylate, butadiene, olefins, or alkylated styrenes. Polyisobutylene is a commonly used viscosity index improver. Another suitable viscosity index improver is polymethacrylate (copolymers of various chain length alkyl methacrylates, for example), some formulations of which also serve as pour point depressants. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

The amount of viscosity modifier may range from 0 to 8 wt %, preferably zero to 4 wt %, more preferably zero to 2 wt % based on active ingredient and depending on the specific viscosity modifier used.

Antioxidants

Typical anti-oxidant include phenolic anti-oxidants, aminic anti-oxidants and oil-soluble copper complexes.

The phenolic antioxidants include sulfurized and non-sulfurized phenolic antioxidants. The terms "phenolic type" or "phenolic antioxidant" used herein includes compounds having one or more than one hydroxyl group bound to an aromatic ring which may itself be mononuclear, e.g., benzyl, or poly-nuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such bi-phenol compounds linked by alkylene bridges sulfuric bridges or oxygen bridges. Alkyl phenols include mono- and poly-alkyl or alkenyl phenols, the alkyl or alkenyl group containing from 3-100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefore, the phenolic anti-oxidant may be represented by the general formula:

$$(R)_x—Ar—(OH)_y$$

where Ar is selected from the group consisting of:

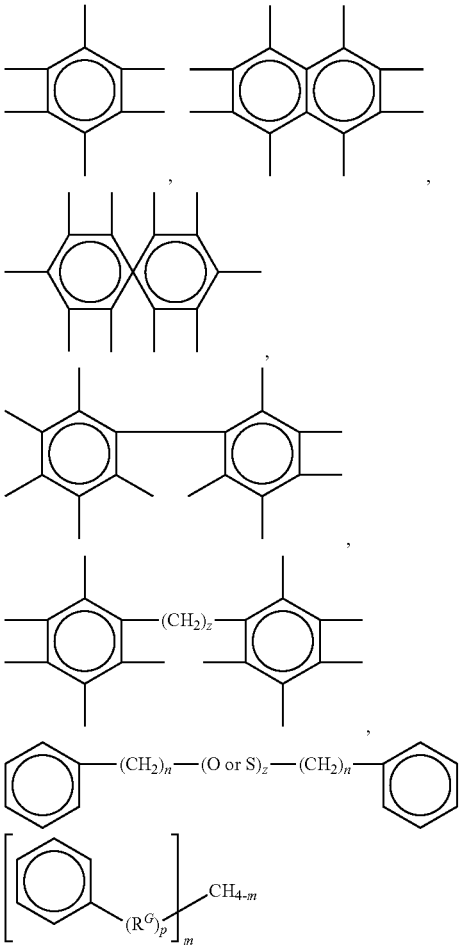

wherein R is a $C_3$-$C_{100}$ alkyl or alkenyl group, a sulfur substituted alkyl or alkenyl group, preferably a $C_4$-$C_{50}$ alkyl or alkenyl group or sulfur substituted alkyl or alkenyl group, more preferably $C_3$-$C_{100}$ alkyl or sulfur substituted alkyl group, most preferably a $C_4$-$C_{50}$ alkyl group, $R^8$ is a $C_1$-$C_{100}$ alkylene or sulfur substituted alkylene group, preferably a $C_2$-$C_{50}$ alkylene or sulfur substituted alkylene group, more preferably a $C_2$-$C_2$ alkylene or sulfur substituted alkylene group, y is at least 1 to up to the available valences of Ar, x ranges from 0 to up to the available valances of Ar-y, z ranges from 1 to 10, n ranges from 0 to 20, and m is 0 to 4 and p is 0 or 1, preferably y ranges from 1 to 3, x ranges from 0 to 3, z ranges from 1 to 4 and n ranges from 0 to 5, and p is 0.

Preferred phenolic anti-oxidant compounds are the hindered phenolics and phenolic esters which contain a sterically hindered hydroxyl group, and these include those derivatives of dihydroxy aryl compounds in which the hydroxyl groups are in the o- or p-position to each other. Typical phenolic anti-oxidants include the hindered phenols substituted with $C_1$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; 2-methyl-6-t-butyl-4-dodecyl phenol; 2,6-di-t-butyl-4 methyl phenol; 2,6-di-t-butyl-4-ethyl phenol; and 2,6-di-t-butyl 4 alkoxy phenol; and

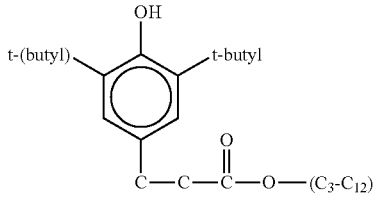

Phenolic type anti-oxidants are well known in the lubricating industry and commercial examples such as Ethanox® 4710, Irganox® 1076, Irganox® L1035, Irganox® 1010, Irganox® L109, Irganox® L118, Irganox® L135 and the like are familiar to those skilled in the art. The above is presented only by way of exemplification, not limitation on the type of phenolic anti-oxidants which can be used.

The phenolic anti-oxidant can be employed in an amount in the range of 0.1 to 3 wt %, preferably 0.25 to 2.5 wt %, more preferably 0.5 to 2 wt % on an active ingredient basis.

Aromatic amine anti-oxidants include phenyl-α-naphthyl amine which is described by the following molecular structure:

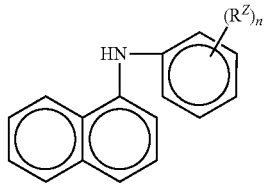

wherein $R^z$ is hydrogen or a $C_1$ to $C_{14}$ linear or $C_3$ to $C_{14}$ branched alkyl group, preferably $C_1$ to $C_{10}$ linear or $C_3$ to $C_{10}$ branched alkyl group, more preferably linear or branched $C_6$ to $C_8$ and n is an integer ranging from 1 to 5 preferably 1. A particular example is Irganox L06.

Other aromatic amine anti-oxidants include other alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to 20 carbon atoms, and preferably contains from 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines anti-oxidants have alkyl substituent groups of at least 6 carbon atoms. Examples of aliphatic groups include hexyl, heptyl, octyl, nonyl, and decyl. Generally, the aliphatic groups will not contain more than 14 carbon atoms. The general types of such other additional amine antioxidants which may be present include diphenylamines, phenothiazines, imidodibenzyls and diphenyl phenylene diamines. Mixtures of two or more of such other additional aromatic amines may also be present. Polymeric amine antioxidants can also be used.

Another class of anti-oxidant used in lubricating oil compositions and which may also be present are oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Such anti-oxidants may be used individually or as mixtures of one or more types of anti-oxidants, the total amount employed being an amount of 0.50 to 5 wt %, preferably 0.75 to 3 wt % (on an as-received basis).

Detergents

In addition to the alkali or alkaline earth metal salicylate detergent which is an optional component in the present disclosure, other detergents may also be present. While such other detergents can be present, it is preferred that the amount employed be such as to not interfere with the synergistic effect attributable to the presence of the salicylate. Therefore, most preferably such other detergents are not employed.

If such additional detergents are present, they can include alkali and alkaline earth metal phenates, sulfonates, carboxylates, phosphonates and mixtures thereof. These supplemental detergents can have total base number (TBN) ranging from neutral to highly overbased, i.e. TBN of 0 to over 500, preferably 2 to 400, more preferably 5 to 300, and they can be present either individually or in combination with each other in an amount in the range of from 0 to 10 wt %, preferably 0.5 to 5 wt % (active ingredient) based on the total weight of the formulated lubricating oil. Furthermore, mixtures of neutral detergents and overbased detergents may be useful.

Such additional other detergents include by way of example and not limitation calcium phenates, calcium sulfonates, magnesium phenates, magnesium sulfonates and other related components (including borated detergents).

Another optional component of the present lubricant compositions is one or more neutral/low TBN or mixture of neutral/low TBN and overbased/high TBN alkali or alkaline earth metal alkylsalicylate, sulfonate and/or phenate detergent preferably neutral/low TBN alkali or alkaline earth metal salicylate and at least one overbased/high TBN alkali or alkalene earth metal salicylate or phenate, and optionally one or more additional neutral and/or overbased alkali or alkaline earth metal alkyl sulfonate, alkyl phenolate or alkylsalicylate detergent, the detergent or detergent mixture being employed in the lubricant composition in an amount sufficient to achieve a sulfated ash content for the finished lubricant of 0.1 mass % to 2.0 mass %, preferably 0.1 to 1.5 mass %, more preferably 0.1 to 1.0 mass %, most preferably 0.1 to 0.7 mass The TBN of the neutral/low TBN alkali or alkaline earth metal alkyl salicylate, alkyl phenate or alkyl sulfonate is 150 or less mg KOH/g of detergent, preferably 120 or less mg KOH/g, most preferably 100 or less mg KOH/g while the TBN of the overbased/high TBN alkali or alkaline earth metal alkyl salicylate, alkyl phenate or alkyl sultanate is 160 or more mg KOH/g, preferably 190 or more mg KOH/g, most preferably 250 or more mg KOH/g, TBN being measured by ASTM D-2896.

The mixture of detergents may be added to the lubricant composition in an amount up to 10 vol % based on active ingredient in the detergent mixture, preferably in an amount up to 8 vol % based on active ingredient, more preferably up to 6 vol % based on active ingredient in the detergent mixture, most preferably between 1.5 to 5.0 vol %, based on active ingredient in the detergent mixture.

By active ingredient is meant the amount of additive actually constituting the name detergent or detergent mixture chemicals in the formulation as received from the additive supplier, less any diluent oil included in the material. Additives are typically supplied by the manufacturer dissolved, suspended in or mixed with diluent oil, usually a light oil, in order to provide the additive in the more convenient liquid form. The active ingredient in the mixture is the amount of actual desired chemical in the material less the diluent oil.

Dispersants

During operation of a mechanical system, automotive engine, industrial compressor, or the like, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the amine or polyamine. For example, the molar ratio of alkenyl succinic anhydride to TEPA can vary from 1:1 to 5:1.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine.

The molecular weight of the alkenyl succinic anhydrides will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from 0.1 to 5 moles of boron per mole of dispersant reaction product.

Mannich base dispersants are made from the reaction of alkylphenols, formaldehyde, and amines. Process aids and catalysts, such as oleic acid and sulfonic acids, can also be part of the reaction mixture. Molecular weights of the alkylphenols range from 800 to 2,500 or more.

Typical high molecular weight aliphatic acid modified Mannich condensation products can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamine reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before. Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this disclosure include the aliphatic aldehydes such as formaldehyde (also as paraformaldehyde and formalin), acetaldehyde and aldol (β-hydroxybutyraldehyde). Formaldehyde or a formaldehyde-yielding reactant is preferred.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from 500 to 5000 or more or a mixture of such hydrocarbylene groups. Other preferred dispersants include succinic acid-esters and amides, alkylphenol-polyamine-coupled Mannich adducts, their capped derivatives, and other related components. Such additives may be used in an amount of 0.1 to 20 wt %, preferably 0.1 to 8 wt %, more preferably 1 to 6 wt % (on an as-received basis) based on the weight of the total lubricant.

Pour Point Depressants

Conventional pour point depressants (also known as lube oil flow improvers) may also be present. Pour point depressant may be added to lower the minimum temperature at which the fluid will flow or can be poured. Examples of suitable pour point depressants include alkylated naphthalenes polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. Such additives may be used in amount of 0.0 to 0.5 wt %, preferably 0 to 0.3 wt %, more preferably 0.001 to 0.1 wt % on an as-received basis.

Corrosion Inhibitors/Metal Deactivators

Corrosion inhibitors are used to reduce the degradation of metallic parts that are in contact with the lubricating oil composition. Suitable corrosion inhibitors include aryl thiazines, alkyl substituted dimercapto thiodiazoles thiadiazoles and mixtures thereof. Such additives may be used in an amount of 0.01 to 5 wt %, preferably 0.01 to 1.5 wt %, more preferably 0.01 to 0.2 wt %, still more preferably 0.01 to 0.1 wt % (on an as-received basis) based on the total weight of the lubricating oil composition.

Sulfur-Containing Compounds

Sulfur-containing compounds useful as additives in this disclosure include, for example, alkyl dithio carbamate, dialkyl dimercaptothiadiazole, other sulfur-containing metal passivators, and combinations of any of the foregoing. The sulfur-containing compounds can be used in conventional amounts.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride and sulfolane-type seal swell agents such as Lubrizol 730-type seal swell additives. Such additives may be used in an amount of 0.01 to 3 wt %, preferably 0.01 to 2 wt % on an as-received basis.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent, preferably 0.001 to 0.5 wt %, more preferably 0.001 to 0.2 wt %, still more preferably 0.0001 to 0.15 wt % (on an as-received basis) based on the total weight of the lubricating oil composition.

Inhibitors and Antirust Additives

Anti-rust additives (or corrosion inhibitors) are additives that protect lubricated metal surfaces against chemical attack by water or other contaminants. One type of anti-rust additive is a polar compound that wets the metal surface preferentially, protecting it with a film of oil. Another type of anti-rust additive absorbs water by incorporating it in a water-in-oil emulsion so that only the oil touches the surface. Yet another type of anti-rust additive chemically adheres to the metal to produce a non-reactive surface. Examples of suitable additives include zinc dithiophosphates, metal phenolates, basic metal sulfonates, fatty acids and amines. Such additives may be used in an amount of 0.01 to 5 wt %, preferably 0.01 to 1.5 wt % on an as-received basis.

Antiwear Agents

Antiwear agents or additives may also be included in the present disclosure. Non-limiting exemplary antiwear agents include ZDDP, zinc dithiocarbamates, molybdenum dialkyldithiophosphates, molybdenum dithiocarbamates, other organo molybdenum-nitrogen complexes, sulfurized olefins, etc.

A metal alkylthiophosphate and more particularly a metal dialkyl dithio phosphate in which the metal constituent is zinc, or zinc dialkyl dithio phosphate (ZDDP) may be present in the lubricating oils of the present disclosure. ZDDP can be primary, secondary or mixtures thereof. ZDDP compounds generally are of the formula $Zn[SP(S)(OR^1)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched and can be derived from primary alcohols, secondary alcohols and mixtures thereof.

Preferable zinc dithiophosphates which are commercially available include secondary zinc dithiophosphates such as those available from for example, the Lubrizol Corporation under the trade designations "LZ 677A", "LZ 1095" and "LZ 1371", from for example Chevron Oronite under the trade designation "OLOA 262" and from, for example, Afton Chemical under the trade designation "HITEC 7169".

The ZDDP is typically used in amounts of from 0.4 wt % to 1.2 wt %, preferably from 0.5 wt % to 1.0 wt %, and more preferably from 0.6 wt % to 0.8 wt %, based on the total weight of the lubricating oil, although more or less can often be used advantageously. Preferably, the ZDDP is a secondary ZDDP and present in an amount of from 0.6 to 1.0 wt % of the total weight of the lubricating oil.

The term "organo molybdenum-nitrogen complexes" embraces the organo molybdenum-nitrogen complexes described in U.S. Pat. No. 4,889,647. The complexes are reaction products of a fatty oil, dithanolamine and a molybdenum source. Specific chemical structures have not been assigned to the complexes. U.S. Pat. No. 4,889,647 reports an infrared spectrum for a typical reaction product of that disclosure; the spectrum identifies an ester carbonyl band at 1740 $cm^{-1}$ and an amide carbonyl band at 1620 $cm^{-1}$. The fatty oils are glyceryl esters of higher fatty acids containing at least 12 carbon atoms up to 22 carbon atoms or more. The molybdenum source is an oxygen-containing compound such as ammonium molybdates, molybdenum oxides and mixtures.

Other organo molybdenum complexes which can be used in the present disclosure are tri-nuclear molybdenum-sulfur compounds described in EP 1 040 115 and WO 99/31113 and the molybdenum complexes described in U.S. Pat. No. 4,978,464.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricant compositions, or functional fluids, to modify the coefficient of friction of a lubricated surface may be effectively used in combination with the base oils or lubricant compositions of the present disclosure if desired. Friction modifiers that lower the coefficient of friction are particularly advantageous in combination with the base oils and lube compositions of this disclosure. Friction modifiers may include metal-containing compounds or materials as well as ashless compounds or materials, or mixtures thereof. Metal-containing friction modifiers may include metal salts or metalligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627, 6,232,276, 6,153,564, 6,143,701, 6,110,878, 5,837,657, 6,010,987, 5,906,968, 6,734,150, 6,730,638, 6,689,725, 6,569,820; and also WO 99/66013; WO 99/47629; and WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from 0.01 weight percent to 10-15 weight percent or more, often with a preferred range of 0.1 weight percent to 5 weight percent. Concentrations of molybdenum-containing materials are often described in terms of Mo metal concentration. Advantageous concentrations of Mo may range from 10 ppm to 3000 ppm or more, and often with a preferred range of 20-2000 ppm, and in some instances a more preferred range of 30-1000 ppm. Friction modifiers of all types may be used alone or in mixtures with the materials of this disclosure. Often mixtures of two or more friction modifiers, or mixtures of friction modifier(s) with alternate surface active material(s), are also desirable.

Typical Amounts of Various Lubricant Oil Components

| Compound | Approximate wt % (useful) | Approximate wt % (preferred) |
|---|---|---|
| Friction Modifiers | 0.01-15 | 0.01-5 |
| Antiwear Additives | 0.01-6 | 0.01-4 |
| Detergents | 0.01-8 | 0.01-4 |
| Dispersants | 0.1-20 | 0.1-8 |
| Antioxidants | 0.01-5 | 0.01-1.5 |
| Anti-foam Agents | 0.001-1 | 0.001-0.1 |
| Corrosion Inhibitors | 0.01-5 | 0.01-1.5 |
| Co-basestocks | 0-50 | 0-40 |
| Base Oils | Balance | Balance |

The multi-aromatic base stocks of this disclosure improve both thermo-oxidation stability and elastomer compatibility/manageability in lubricating applications. The use of multi-aromatic base stocks are desirable in lubricating oils in the presence of salicylate, sulfonate and phenate detergents, along with antioxidants and ashless antioxidants, along with succinimide based dispersants, along with zinc dialkyldithiophosphates, along with organic and metallic friction modifiers, along with corrosion inhibitors, along with defoamants and optionally in the presence of Group I, Group II, Group III, Group IV and Group V base oils. Furthermore, the use of the multi-aromatic base stocks are desirable in engine oils with low sulfated ash levels (measured by ASTM D874) of 1 wt % or less, more preferred at levels 0.8 wt % or less.

In the above detailed description, the specific embodiments of this disclosure have been described in connection with its preferred embodiments. However, to the extent that the above description is specific to a particular embodiment or a particular use of this disclosure, this is intended to be illustrative only and merely provides a concise description of the exemplary embodiments. Accordingly, the disclosure is not limited to the specific embodiments described above, but rather, the disclosure includes all alternatives, modifications, and equivalents falling within the true scope of the appended claims. Various modifications and variations of this disclosure will be obvious to a worker skilled in the art and it is to be understood that such modifications and variations are to be included within the purview of this application and the spirit and scope of the claims.

EXAMPLES

The multi-naphthalene base stocks used in the Examples were prepared by various methods. The methods provide for the building molecular weight of alkyl naphthalene. The methods maintain high aromatic nature of the molecule while increasing molecular weight.

One method involved building molecular weight of alkyl naphthalene by connecting multiple alkyl naphthalene molecules directly (Method 1) as follows:

Method 1: Oxidative Coupling of Alkyl Naphthalene

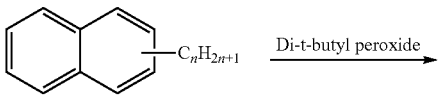

-continued

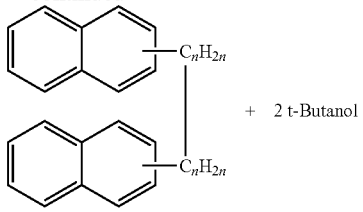

Another method involved building molecular weight of alkyl naphthalene by connecting multiple alkyl naphthalene molecules through a carbon (Method 2) as follows:

Method 2: Condensation Via Electrophilic Alkylation of Alkyl Naphthalene with Aldehyde

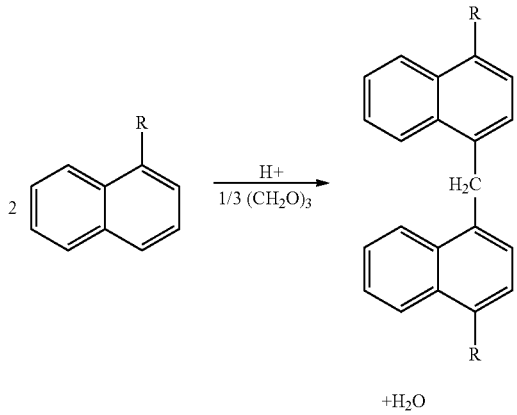

Still another method involved introducing alkyl chains to an aromatic core containing two or more naphthalene rings (Method 3) as follows:

Method 3: Electrophilic Alkylation of Multi-Naphthalene Core with Olefins or Alkyl Halides

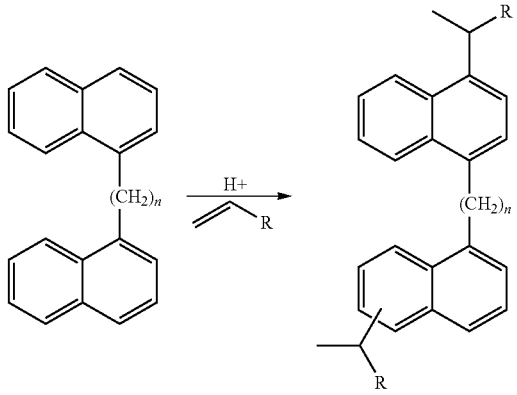

n >= 0

FIG. 1 lists basestocks or molecules that were prepared and examined by differential scanning calorimetry (DSC, 100 psi air, 10° C./min) to determine the oxidation onset temperature. Two commercial AN products were used as references for comparison. In all cases, molecules or basestocks containing multiple naphthalene moieties showed >30° C. higher oxidation onset temperature compared to those with containing only one naphthalene moiety (e.g. AN 5 and AN 12). Conventional alkylated naphthalenes (ANs) used in the Examples (e.g., AN 5 and AN 12) are commercially available materials under various trade names such as Synesstic™ and KR™ alkylated naphthalenes.

Formulations

Industrial formulations were prepared for thermo-oxidative stability testing. Formulations included either 25 wt % or 50 wt % of commercial AN and multi-naphthalene base stock with the balance containing PAO (4 $mm^2/s$ and/or 150 $mm^2/s$) and typical industrial oil additives.

Oxidation Test

The reaction of oxygen with the lubricant base stock and additives can produce aldehydes, ketones, hydroperoxides and carboxylic acids. Oxidation is observed in used oil analysis via laboratory tests such as Total Acid Number (TAN) and Kinematic Viscosity. Tests conducted in high temperature glassware environments (e.g., 150° C.), in the presence of metal catalysts, to determine whether a particular oil has a long oil life when compared to other oils or references. During the tests, the oil was periodically sampled and its properties measured. Oil condition was examined by measuring Kinematic Viscosity at a specified temperature (100° C.) and Total Acid Number (by calorimetric or potentiometric titration). Comparisons were made to the original oil properties and other lubricant formulations. Radical Coupled AN was compared to three commercial AN products in the formulation set forth in FIG. 2. The results are set forth in FIG. 2. Alkyl-1,1'-binaphthyl was compared to three commercial AN products in the formulation set forth in FIG. 3. The results are set forth in FIG. 3.

Elastomer Compatibility Test

The effect of the basestocks on elastomers were tested in the formulations using a reference Nitrile rubber (NBR 28 SX) at 100° C. for 168 hours. The volume of the nitrile rubber samples was measured at the end of the test and compared to that before the test. Higher numbers indicate more swelling and interaction between the base stocks and the elastomer materials. Radical Coupled AN was compared to three commercial AN products in the formulation set forth in FIG. 2. The results are set forth in FIG. 2. Alkyl-1,1'-binaphthyl was compared to three commercial AN products in the formulation set forth in FIG. 3. The results are set forth in FIG. 3.

The results set forth in FIGS. 2 and 3 show that the formulations containing the multi-naphthalene base stocks have good oxidation resistance at 150° C. with low TAN similar to the current low viscosity AN (AN 5) and much better than the higher viscosity AN products (AN 9 and AN 19). At the same time, the multi-naphthalene base stocks showed significant less interaction with the nitrile rubber elastomers comparable to the higher viscosity AN and outperform the low viscosity AN.

FIG. 4 lists gas chromatographic (GC) data for various mono-alkyl, di-alkyl, tri-alkyl, and tetra-alkyl naphthalenes, and also aromatic/aliphatic carbon ratios and kinematic viscosities (100° C. $mm^2/s$ and 40° C. $mm^2/s$) of the various naphthalenes. The calculation of the aromatic/aliphatic carbon ratio was by the formula $$\text{Aromatic/Aliphatic Carbon Ratio}=C*(W_1/MW_1+2*W_2/MW_2+3*W_3/MW_3+4*W_4/MW_4)/(10*(W_1/MW_1+W_2/MW_2+W_3/MW_3+W_4/MW_4))$$

wherein C is the alkyl chain length, W is the weight percent of mono-alkyl, di-alkyl, tri-alkyl and tetra-alkyl naphthalene, and MW is the molecular weight of mono-alkyl, di-alkyl, tri-alkyl and tetra-alkyl naphthalene.

An oxidative coupling reaction was carried out in accordance with Method 1 above. AN 5 was used as the starting material. The product mixture contained unreacted starting materials and their oligomers as shown by mass spectroscopic analysis in FIG. 5. Molecular ions of 702.7, 927.1 and higher represent oligomeric products derived from starting material that contains mostly mono-hexadecyl naphthalene (m/e 352.3) and a small amount of di-hexadecyl naphthalene (m/e 5 76.7). FIG. 5 shows the mass spectrographic analysis of the product.

As shown in the Examples, the multi-naphthalene base stock approach provides a new class of materials that combines the oxidation performance of a low viscosity AN and the elastomer compatibility of a high viscosity AN that cannot be achieved by conventional materials or methods.

PCT and EP Clauses:

1. A method for improving thermo-oxidative stability and elastomer compatibility in an apparatus lubricated with a lubricating oil by using as the lubricating oil a formulated oil comprising a lubricating oil base stock; wherein the lubricating oil base stock comprises a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1; wherein the multi-aromatic base stock has a kinematic viscosity greater than 20 $mm^2/s$ at 100° C.; and wherein thermo-oxidative stability and elastomer compatibility are improved as compared to thermo-oxidative stability and elastomer compatibility achieved using a lubricating oil base stock other than the multi-aromatic base stock.

2. The method of clause 1 wherein, in the multi-aromatic base stock, $R^2$ is substituted or unsubstituted naphthalene, $R^1$ is H, X is an alkylene linkage, and n is a number from 1 to 1000.

3. The method of clauses 1 and 2 wherein, in the multi-aromatic base stock, the ratio of the total number of aromatic ring carbon atoms to aliphatic carbon atoms in said formula is greater than 0.44:1.

4. The method of clauses 1-3 wherein the multi-aromatic base stock comprises 1,1'-binaphthyl, 2,2'-binaphthyl, alkyl-1,1'-binaphthyl, bis-α-methylnaphthalene methane, bis-β-methylnaphthalene methane, alkylated bis-α-methylnaphthalene methane, alkylated bis-β-methylnaphthalene methane, 1,1'-(1,2-ethanediyl)bis-naphthalene, alkylated 1,1'-(1,2-ethanediyl)bis-naphthalene, or mixtures thereof.

5. The method of clauses 1-4 wherein the multi-aromatic base stock is present in an amount from 5 weight percent to 95 weight percent, based on the total weight of the lubricating oil.

6. A lubricating oil comprising a lubricating oil base stock; wherein the lubricating oil base stock comprises a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1; wherein the multi-aromatic base stock has a kinematic viscosity greater than 20 $mm^2/s$ at 100° C.; and wherein, in an apparatus lubricated with said lubricating oil, thermo-oxidative stability and elastomer compatibility are improved as compared to thermo-oxidative stability and elastomer compatibility achieved using a lubricating oil base stock other than the multi-aromatic base stock.

7. The lubricating oil of clause 6 wherein, in the multi-aromatic base stock. $R^2$ is substituted or unsubstituted naphthalene, $R^1$ is H, X is an alkylene linkage, and n is a number from 1 to 1000.

8. The lubricating oil of clauses 6 and 7 wherein, in the multi-aromatic base stock, the ratio of the total number of aromatic ring carbon atoms to aliphatic carbon atoms in said formula is greater than 0.44:1.

9. The lubricating oil of clauses 6-8 wherein the multi-aromatic base stock comprises 1,1'-binaphthyl, 2,2'-binaphthyl, alkyl-1,1'-binaphthyl, bis-α-methylnaphthalene methane, bis-β-methylnaphthalene methane, alkylated bis-α-methylnaphthalene methane, alkylated bis-β-methylnaphthalene methane, 1,1'-(1,2-ethanediyl)bis-naphthalene, alkylated 1,1'-(1,2-ethanediyl)bis-naphthalene, or mixtures thereof.

10. The lubricating oil of clauses 6-9 wherein the multi-aromatic base stock is present in an amount from 5 weight percent to 95 weight percent, based on the total weight of the lubricating oil.

11. A multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1; wherein the multi-aromatic base stock has a kinematic viscosity greater than 20 $mm^2/s$ at 100° C.; and wherein, in an apparatus lubricated with a lubricating oil comprising said multi-aromatic base stock, thermo-oxidative stability and elastomer compatibility are improved as compared to thermo-oxidative stability and elastomer compatibility achieved using a lubricating oil base stock other than the multi-aromatic base stock.

12. The multi-aromatic base stock of clause 11 wherein $R^2$ is substituted or unsubstituted naphthalene, $R^1$ is H, X is an alkylene linkage, and n is a number from 1 to 1000.

13. The multi-aromatic base stock of clauses 11 and 12 wherein the ratio of the total number of aromatic ring carbon atoms to aliphatic carbon atoms in said formula is greater than 0.44:1.

14. The multi-aromatic base stock of clauses 11-13 comprising 1,1'-binaphthyl, 2,2'-binaphthyl, alkyl-1,1'-binaphthyl, bis-α-methylnaphthalene methane, bis-β-methylnaphthalene methane, alkylated bis-α-methylnaphthalene methane, alkylated bis-β-methylnaphthalene methane, 1,1'-(1,2-ethanediyl)bis-naphthalene, alkylated 1,1'-(1,2-ethanediyl)bis-naphthalene, or mixtures thereof.

15. The lubricating oil of clause 6 which further comprises one or more of a viscosity improver, antioxidant, detergent, dispersant, pour point depressant, corrosion inhibitor, metal deactivator, seal compatibility additive, anti-foam agent, inhibitor, and anti-rust additive.

All patents and patent applications, test procedures (such as ASTM methods. UL methods, ISO methods, and the like), and other documents cited herein are fully incorporated by reference to the extent such disclosure is not inconsistent with this disclosure and for all jurisdictions in which such incorporation is permitted.

When numerical lower limits and numerical upper limits are listed herein, ranges from any lower limit to any upper limit are contemplated. While the illustrative embodiments of the disclosure have been described with particularity, it will be understood that various other modifications will be apparent to and can be readily made by those skilled in the art without departing from the spirit and scope of the disclosure. Accordingly, it is not intended that the scope of the claims appended hereto be limited to the examples and descriptions set forth herein but rather that the claims be construed as encompassing all the features of patentable novelty which reside in the present disclosure, including all features which would be treated as equivalents thereof by those skilled in the art to which the disclosure pertains.

The present disclosure has been described above with reference to numerous embodiments and specific examples. Many variations will suggest themselves to those skilled in this art in light of the above detailed description. All such obvious variations are within the full intended scope of the appended claims.

What is claimed is:

1. A method for improving thermo-oxidative stability and elastomer compatibility in an apparatus lubricated with a lubricating oil by using as the lubricating oil a formulated oil comprising a lubricating oil base stock; wherein the lubricating oil base stock comprises from about 25 to 50 wt. % of a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1; wherein the multi-aromatic base stock has a kinematic viscosity greater than 20 $mm^2/s$ at 100° C.; and wherein thermo-oxidative stability and elastomer compatibility are improved as compared to thermo-oxidative stability and elastomer compatibility achieved using a lubricating oil base stock other than the multi-aromatic base stock.

2. The method of claim 1 wherein, in the multi-aromatic base stock, $R^2$ is substituted or unsubstituted naphthalene, $R^1$ is H, X is an alkylene linkage, and n is a number from 1 to 1000.

3. The method of claim 1 wherein, in the multi-aromatic base stock, the ratio of the total number of aromatic ring carbon atoms to aliphatic carbon atoms in said formula is greater than 0.44:1.

4. The method of claim 1 wherein the multi-aromatic base stock comprises 1,1'-binaphthyl, 2,2'-binaphthyl, alkyl-1,1'-binaphthyl, bis-α-methylnaphthalene methane, bis-β-methylnaphthalene methane, alkylated bis-α-methylnaphthalene methane, alkylated bis-β-methylnaphthalene methane, 1,1'-(1,2-ethanediyl)bis-naphthalene, alkylated ethanediyl)bis-naphthalene, or mixtures thereof.

5. The method of claim 1 wherein the lubricating oil further comprises a Group I, II, III, IV or V base oil stock.

6. The method of claim 1 wherein the lubricating oil further comprises a poly alpha olefin (PAO) or gas-to-liquid (GTL) oil base stock.

7. The method of claim 1 wherein the lubricating oil further comprises one or more of a viscosity improver, antioxidant, detergent, dispersant, pour point depressant, corrosion inhibitor, metal deactivator, seal compatibility additive, anti-foam agent, inhibitor, and anti-rust additive.

8. A lubricating oil comprising a lubricating oil base stock; wherein the lubricating oil comprises from about 25 to 50 wt. % of a multi-aromatic base stock of the formula:

$$R^1—R^2—(X—R^2)_n—R^1$$

wherein each $R^1$ is the same or different and is a terminal group, each $R^2$ is the same or different and represents a substituted or unsubstituted aromatic moiety; each X is a linking moiety that is carbon-carbon single bond or a linking group, n is a number from 1 to 2000, and the ratio of the total number of aromatic ring carbon atoms to aliphatic carbon atoms in said formula is greater than 0.32:1; wherein the multi-aromatic base stock has a kinematic viscosity greater than 20 $mm^2/s$ at 100° C.; and wherein, in an apparatus lubricated with said lubricating oil, thermo-oxidative stability and elastomer compatibility are improved as compared to thermo-oxidative stability and elastomer compatibility achieved using a lubricating oil base stock other than the multi-aromatic base stock.

9. The lubricating oil of claim 8 wherein, in the multi-aromatic base stock, $R^2$ is substituted or unsubstituted naphthalene, $R^1$ is H, X is an alkylene linkage, and n is a number from 1 to 1000.

10. The lubricating oil of claim 8 wherein, in the multi-aromatic base stock, the ratio of the total number of aromatic ring carbon atoms to aliphatic carbon atoms in said formula is greater than 0.44:1.

11. The lubricating oil of claim 8 wherein the multi-aromatic base stock comprises 1,1'-binaphthyl, 2,2'-binaphthyl, alkyl-1,1'-binaphthyl, bis-α-methylnaphthalene methane, bis-β-methylnaphthalene methane, alkylated bis-α-methylnaphthalene methane, alkylated bis-β-methylnaphthalene methane, 1,1'-(1,2-ethanediyl)bis-naphthalene, alkylated 1,1'-(1,2-ethanediyl)bis-naphthalene, or mixtures thereof.

12. The lubricating oil of claim 8 wherein the lubricating oil further comprises a Group I, II, III, IV or V base oil stock.

13. The lubricating oil of claim 8 wherein the lubricating oil further comprises a poly alpha olefin (PAO) or gas-to-liquid (GTL) oil base stock.

14. The lubricating oil of claim 8 wherein the lubricating oil further comprises one or more of a viscosity improver, antioxidant, detergent, dispersant, pour point depressant, corrosion inhibitor, metal deactivator, seal compatibility additive, anti-foam agent, inhibitor, and anti-rust additive.

15. The method of claim 7 wherein the lubricating oil comprises a multi-aromatic base stock, a salicylate, sulfonate or phenate based detergent, an ashless antioxidant, a succinimide based dispersant, a zinc dialkyldithiophosphate (ZDDP), a friction modifier, a corrosion inhibitor, and a defoamant.

16. The lubricating oil of claim 14 which comprises a multi-aromatic base stock, a salicylate, sulfonate or phenate based detergent, an ashless antioxidant, a succinimide based dispersant, a zinc dialkyldithiophosphate (ZDDP), a friction modifier, a corrosion inhibitor, and a defoamant.

* * * * *